US010199018B2

(12) United States Patent
Suenaga

(10) Patent No.: US 10,199,018 B2
(45) Date of Patent: Feb. 5, 2019

(54) MUTE

(71) Applicant: Yamaha Corporation, Hamamatsu-shi, Shizuoka (JP)

(72) Inventor: Yuichiro Suenaga, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/909,662

(22) Filed: Mar. 1, 2018

(65) Prior Publication Data

US 2018/0190247 A1 Jul. 5, 2018

Related U.S. Application Data

(63) Continuation of application No. PCT/JP2016/064399, filed on May 13, 2016.

(30) Foreign Application Priority Data

Sep. 2, 2015 (JP) ..... 2015-172522

(51) Int. Cl.
*G10D 9/06* (2006.01)
*G10K 11/16* (2006.01)

(52) U.S. Cl.
CPC ..... *G10D 9/06* (2013.01); *G10K 11/16* (2013.01)

(58) Field of Classification Search
CPC ..... G10K 11/16; G10D 9/06
See application file for complete search history.

(56) References Cited

U.S. PATENT DOCUMENTS 1,445,115 A 2/1923 Turner
2,248,352 A * 7/1941 Humes ..... G10D 9/06 84/400
2,439,733 A * 4/1948 Hermes ..... G10D 9/06 84/400

FOREIGN PATENT DOCUMENTS

JP 3552026 B2 8/2004

OTHER PUBLICATIONS

Japanese-language International Search Report (PCT/ISA/210) issued in PCT Application No. PCT/JP2016/064399 with English translation dated Jul. 26, 2016 (three (3) pages).
Schlipf mutes [online], Jan. 24, 2008, Internet::<URL:http://www.tuba-mute.com/index.php?lang=de&page =tourmute.

* cited by examiner

*Primary Examiner* — Kimberly Lockett
(74) *Attorney, Agent, or Firm* — Crowell & Moring LLP

(57) ABSTRACT

A mute is provided that can be stored together with a wind instrument. A mute comprises a main body portion, a rod-like member, and an inner head. The main body portion comprises a body, a head, and a connecting member. When in use, a large diameter end of the body is connected to a large diameter end of the head. When the inner head is in a bell, the body is fixed to the inner circumferential face of the bell. For storage, the mute is reassembled into a mode for storage in which the body is separated from the head, the head is in the head, and the inner head is in the head. The entire mute reassembled into this mode is in the bell.

7 Claims, 12 Drawing Sheets

MUTE

TECHNICAL FIELD

The present invention relates to a mute for use in a wind instrument.

BACKGROUND ART

A mute has been known which is used by being attached to a bell for the purpose of reducing the volume of sound produced by a wind instrument during playing. A bell of a wind instrument refers to a portion which is close to an outlet for exhaled air where the diameter of a pipe of the wind instrument gradually increases in order to increase the volume of sound. In the specification of the present invention, the direction from the end of the bell of the wind instrument toward the inside thereof is referred to as "in rear", and the direction from the end of the bell of the wind instrument away from the bell is referred to as "in front".

PRIOR ART DOCUMENTS

Patent Documents

Patent Document 1: Japanese Patent No. 3552026

SUMMARY OF THE INVENTION

Problems to be Solved by the Invention

A mute is an essential device when playing a wind instrument at a place or in a situation where playing loud is not allowed. Therefore, it is convenient to store a mute and a wind instrument together, for example in a musical instrument storing case. When a mute and a wind instrument are stored together, carrying of a mute and a wind instrument together can be less cumbersome, and a user can readily use the mute when playing a wind instrument. However, a space for storing is limited for most of such musical instrument storing cases. Particularly, the only usable space left in the musical instrument storing case in which a wind instrument is stored is a space within a bell of the wind instrument, except for an accessory case for storing maintenance articles or the like. Since a space provided in the accessory case is often smaller than the space within the bell, it is desired to store a mute in the space within the bell of a wind instrument.

This type of mute for a wind instrument includes a mute provided with an inner head, which inhibits a sound from going off-key during playing of the wind instrument with the mute. The inner head is, for example, a member to forma gap that allows exhaled air to pass between the inner circumferential face of a bell and the inner head. It is more difficult to store such a mute provided with the inner head together with the wind instrument.

The present invention was made in view of such circumstances and has an objective of providing a mute that is enabled to be stored together with a wind instrument.

Means for Solving the Problems

According to an aspect of the present invention, a mute comprises a pipe-like hollow body comprising a small diameter end and a large diameter end, with both ends being open; a pipe-like hollow head comprising a small diameter end which is closed by a bottom member and has a through-hole at the bottom member, and a large diameter end which is open and has a same diameter as that of the large diameter end of the body, wherein the head is connectable to the body such that the large diameter end of the body faces the large diameter end of the head to join therewith; a rod-like member that is inserted into the through-hole and is slidable in an axial direction; and an inner head that is fixed to one end of the rod-like member to be supported by the head, wherein in storing, the body and the head are separated from each other, and the head is placed in a space surrounded by an inner circumferential face of the body, and the inner head is placed in a space surrounded by an inner circumferential face of the head.

When the mute of the aspect of the present invention is to be used, the body is connected to the head such that the large diameter end of the body faces the large diameter end of the head to join therewith. The mute in this state mutes (muffles) a sound in a bell by the space surrounded by the inner circumferential face of the body and the space surrounded by the inner circumferential face of the head. On the other hand, when the mute of the aspect of the present invention is to be stored, the body is separated from the head, the head is placed in the space surrounded by the inner circumferential face of the body, and the inner head is placed in the space surrounded by the inner circumferential face of the head. When the body of the mute in this state is inserted into the bell, the entire mute is placed in the space in the bell. Therefore, according to the present invention, a mute is provided that is enabled to be stored together with a wind instrument.

Furthermore, when the body is connected to the head in the mute, the inner head is located at an appropriate position within the bell due to sliding of the rod-like member. Therefore, between the inner circumferential face of the bell and the inner head, a gap is formed through which exhaled air is led into a space in the body and the head. As such, according to the aspect of the present invention, inhibiting a sound from going off-key during playing with the mute is enabled.

As an example of a mute, Patent Document 1 discloses a mute for a tuba. The mute for a tuba according to Patent Document 1 comprises: a mute main body; a support that extends in rear from the mute main body; and an adjustment cylinder that extends in rear from the support. The mute main body of the mute for a tuba comprises: an annular rear end that allows an opening rim portion to abut a bell of the tuba at a position near the front end of the bell; a front wall which is located in front, away from the end of the bell; and a side wall that connects the rear end with the front wall. Since the opening rim portion of the rear end of the mute main body abut the bell of the tuba at the position near the front end of the bell, the most part of the mute main body is located outside the end of the bell. As a result, the mute for the tuba cannot be entirely placed in the space within the bell. Accordingly, the mute for the tuba cannot be stored together with the wind instrument.

DESCRIPTION OF EMBODIMENTS

Hereinafter, embodiments of the present invention will be described with reference to the drawings.

First Embodiment

A mute 1 according to the first embodiment of the present invention is a mute for a tuba. In the specification of the present invention, a center line as a rotation symmetry axis of a pipe-like member or a rod-like member is referred to as an axis of the member.

Figure 1:
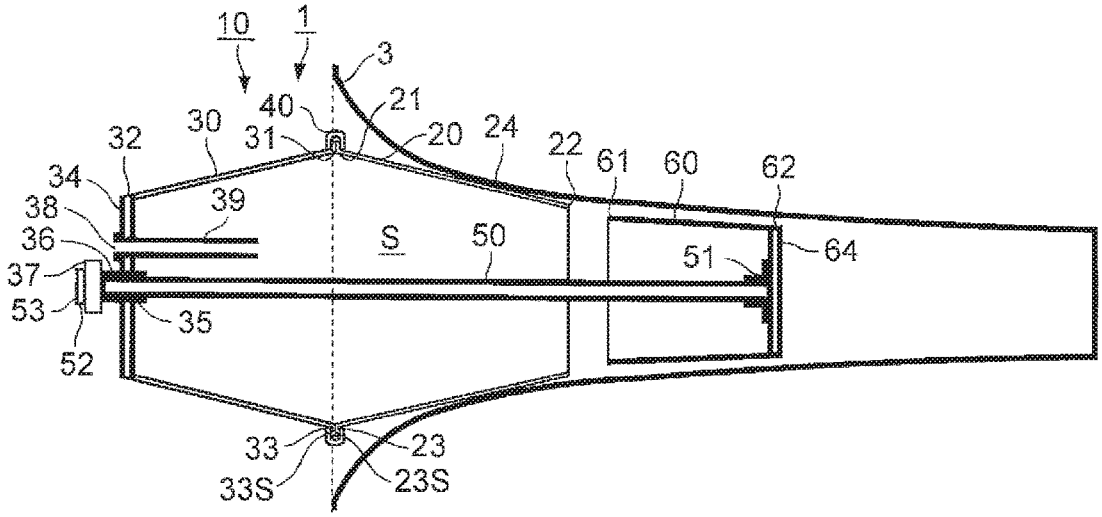
FIG. 1 is a longitudinal cross sectional view showing a configuration of a mute 1 in use according to the first embodiment of the present invention.
Figure 2:
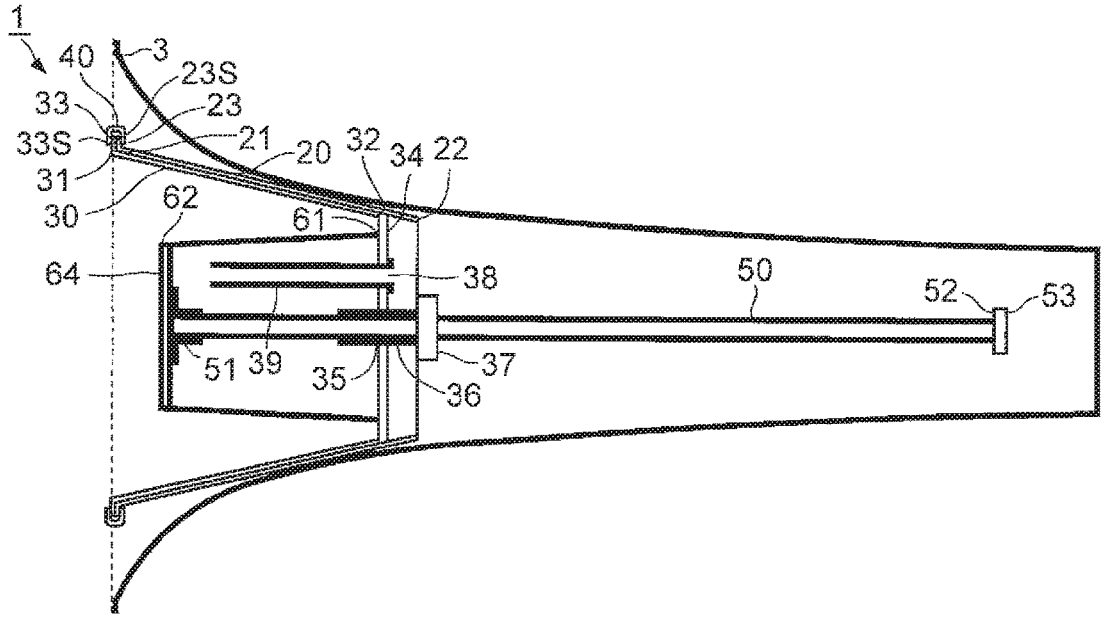
FIG. 2 is a longitudinal cross sectional view showing a configuration of the mute 1 when stored.

FIGS. 1 and 2 shows a longitudinal cross section provided by cutting a mute 1 and a bell 3 along the axis of the bell 3 in which the mute 1 according to the present embodiment is stored. In the present embodiment, the modes of the mute 1 differ between the case of serving as a mute (i.e. performing a mute function) and the case of being stored in a musical instrument storing case when carried. FIG. 1 represents a state in which the mute 1 in the mode for use is being attached to the bell 3 and which thus corresponds to the former case. FIG. 2 represents a state in which the mute 1 in the mode for storage is being placed in the bell 3 and which thus corresponds to the latter case. In the present embodiment, a user is capable of reassembling the mute 1 from the mode for use shown in FIG. 1 to the mode for storage shown in FIG. 2 as well as from the mode for storage shown in FIG. 2 to the mode for use shown in FIG. 1.

The mute 1 is used by being attached to the bell 3 of a wind instrument. The mute 1 comprises a main body portion 10, a rod-like member 50, and an inner head 60. The main body portion 10 comprises a body 20, a head 30, and a connecting member 40. The body 20 and the head 30 is connectable to each other by means of the connecting member 40, and is separable from each other by removing the connecting member 40.

The body 20 is a hollow member having a substantially conical pipe-like shape. The term "substantially conical pipe-like shape" as referred to herein means a shape of a pipe of which cross section perpendicular to the axis is circular and of which outer and inner diameters gradually increase (or decrease) from one end toward the other end thereof. Furthermore, an end having larger outer and inner diameters of the substantially conical-pipe-like member is referred to as a large diameter end, and an end having smaller outer and inner diameters of the substantially conical pipe-like member is referred to as a small diameter end. The large diameter end 21 and the small diameter end 22 of the body 20 are both open. The body 20 is inserted into the bell 3 from the small diameter end 22 side of the body 20. Therefore, the small diameter end 22 of the body 20 corresponds to a rear end of the body 20, and the large diameter end 21 of the body 20 corresponds to a front end of the body 20.

A buffer material 24 such as a sponge formed from a soft material such as urethane is provided around the axis of the body 20 on the outer circumferential face of the body 20. The body 20 placed in the bell 3 is fixed to the bell 3, with the buffer material 24 being interposed between the outer circumferential face of the body 20 and the inner circumferential face of the bell 3. In this state, the space between the outer circumferential face of the body 20 and the inner circumferential face of the bell 3 is filled with the buffer material 24. Furthermore, the sizes of the large diameter end 21 and the small diameter end 22 are determined in such a manner that the large diameter end 21 is located close to or in rear of the end of the bell 3, in the state of the body 20 being fixed to the inner circumferential face of the bell 3 (in other words, the large diameter end 21 is configured to be located close to or in rear of the end position of the bell 3 in the axial direction in the state of the body 20 being fixed to the inner circumferential face of the bell 3). In the example of FIG. 1, the large diameter end 21 of the body 20 is aligned with the end of the bell 3. Furthermore, in the example of FIG. 1, the body 20 has a diameter which increases in such a manner that the body 20 roughly follows the shape of the inner circumferential face of the bell 3 from the small diameter end 22 toward the large diameter end 21.

A flange 23 is provided at the large diameter end 21 of the body 20. The flange 23 is a plate-like member that protrudes from the large diameter end 21 in a direction away from the axis of the body 20. The outer edge of the flange 23 has a circular shape. The outer diameter of the flange 23 is smaller than the inner diameter of the end of the bell 3.

The head 30 is a hollow member having a substantially conical pipe-like shape. Similar to the body 20, the head 30 comprises a small diameter end 32 on one end and a large diameter end 31 on the other end in the axial direction. The large diameter end 31 is an open end and the small diameter end 32 is a closed end. The head 30 is shorter than the body 20 in the axial direction. The large diameter end 31 of the head 30 is formed to have the same diameter as the large diameter end 21 of the body 20. The inner diameter of the large diameter end 31 of the head 30 has the same diameter as the inner diameter of the large diameter end 21 of the body 20.

A flange 33 is provided at the large diameter end 31 of the head 30. The flange 33 is a plate-like member that protrudes from the large diameter end 31 in a direction away from the axis of the head 30. The outer edge of the flange 33 has a circular shape. The outer diameter of the flange 33 of the head 30 has the same diameter as the outer diameter of the flange 23 of the body 20.

The outer diameter of the small diameter end 32 of the head 30 is approximately the same as the outer diameter of the small diameter end 32 of the body 20. A bottom member 34 is provided at the small diameter end 32 of the head 30. The bottom member 34 is a circular plate-like member that closes the small diameter end 32 of the head 30. The edge of the bottom member 34 is continuous with a side wall of the head 30. The bottom member 34 is substantially perpendicular to the axis of the head 30. A face of the bottom member 34 directed to the space surrounded by the inner circumferential face of the head 30 is referred to as an inner face, and a face of the bottom member 34 opposite to the inner face is referred to as an outer face.

Figure 3:
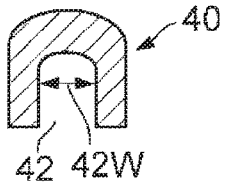
FIG. 3 is a cross sectional view showing a configuration of a connecting member 40 of the mute 1.

The head 30 and the body 20 are connectable to each other by means of the connecting member 40. Specifically, the connecting member 40 is a circular member formed from an elastic body such as rubber. FIG. 3 is a cross sectional view showing a cross section of the connecting member 40 taken along a plane perpendicular to the circumference of the connecting member 40. As shown in FIG. 3, the cross section of the connecting member 40 is substantially U-shaped, in which the vicinity of the center of the inner circumferential face of the connecting member 40 is recessed in the outer circumferential direction.

In the mute 1 in the mode for use shown in FIG. 1, a sealing face 23S of the flange 23 corresponding to the large diameter end 21 faces a sealing face 33S of the flange 33 corresponding to the large diameter end 31 to join therewith. The connecting member 40 is attached to the flanges 23 and 33 in such a manner that both the flanges 23 and 33 are inserted into a recess 42 thereof, whereby the body 20 and the head 30 are connected to and fixed with each other. When the body 20 is connected to the head 30 in this way, the body 20 and the head 30 are hermetically joined together. Furthermore, in such a state, a space S is provided in which a space surrounded by the inner circumferential face in the body 20 (a space in the body 20) and a space surrounded by the inner circumferential face in the head 30 (a space in the head 30) are integrated.

As shown in FIG. 1, a circular through-hole 35 that is continuous through the bottom member 34 is provided at the center of the bottom member 34 of the head 30. A cylindrical rod-like member 50 is inserted into the through-hole 35. The rod-like member 50 inserted into the through-hole 35 is slidable in the axial direction with respect to the bottom member 34. The rod-like member 50 is longer than the total length of the head 30 and the body 20 in the axial direction.

A collar 53 is provided at an end 52 of the rod-like member 50 on the outer face of the bottom member 34. The collar 53 prevents the rod-like member 50 from exiting from the through-hole 35 when it is slid in a direction from the end 52 toward an end 51 on the inner face of the bottom member 34.

A stopper 36 is provided at the through-hole 35 at the bottom member 34. The stopper 36 is a slide restriction means that restricts the sliding of the rod-like member 50 to fix the rod-like member 50 to the head 30. The stopper 36 is, for example, switchable between a mode permitting sliding of the rod-like member 50 and a mode fixing the rod-like member 50 to the head 30, through a rotational operation of a rotation operator 37 by a user. The through-hole 35 is sealed when the rod-like member 50 is fixed to the head 30.

The inner head 60 comprises an outer circumferential face having an outer diameter which gradually increases from the small diameter end toward the large diameter end. In the example of FIG. 1, the inner head 60 has a substantially conical pipe-like hollow shape. The inner head 60 is shorter than the head 30 in the axial direction. The large diameter end 61 of the inner head 60 is open. The outer diameter of the large diameter end 61 of the inner head 60 is smaller than the inner diameter of the small diameter end 22 of the body 20.

A bottom member 64 is provided at a small diameter end 62 of the inner head 60. The bottom member 64 is a circular plate-like member that closes the small diameter end 62 of the inner head 60. The edge of the bottom member 64 is continuous with a side wall of the head 60. The bottom member 64 is substantially perpendicular to the axis of the inner head 60. A face of the bottom member 64 directed to the space surrounded by the inner circumferential face of the inner head 60 is referred to as an inner face, and a face of the bottom member 64 opposite to the inner face is referred to as an outer face.

In the example of FIG. 2, the inner head 60 is supported by the head 30 by being fixed to the rod-like member 50 in such a manner that the large diameter end 61 of the inner head 60 faces the inner face of the bottom member 34 of the head 30. More specifically, the end 51 of the rod-like member 50 is fixed to the center portion of the inner face of the bottom member 64 of the inner head 60. The inner head 60 is placed in the head 30, as the rod-like member 50 is slid in a direction from the end 51 toward the end 52. Yet more specifically, as shown in FIG. 2, when the large diameter end 61 of the inner head 60 is located close to the inner face of the bottom member 34 of the head 30, the small diameter end 62 of the inner head 60 is located more interiorly than the large diameter end 31 of the head 30. On the other hand, the inner head 60 placed in the head 30 exits the head 30 from the large diameter end 31 of the head 30, as the rod-like member 50 is slid in a direction from the end 52 toward the end 51. In the mode for use shown in FIG. 1, the entire inner head 60 is being located outside the head 30 so that the large diameter end 61 of the inner head 60 faces the large diameter end 31 of the head 30, and thus, the small diameter end 62 of the inner head 60 is located in a space outside the space S.

An air hole 38 is provided which is continuous through the bottom member 34 of the head 30. The air hole 38 is, for example, a circular hole, and is provided at a position off the center of the bottom member 34. One end of a cylindrical pipe 39, having both ends being open and having the same inner diameter as that of the air hole 38, is fixed to an edge portion of the air hole 38 on the inner face of the bottom member 34. The pipe 39 is shorter than the inner head 60 in the axial direction. In other words, the pipe 39 is provided so as not to prevent the inner head 60 from being placed in the head 30. The inner diameter of the pipe 39 and the diameter of the air hole 38 are equal to or greater than the minimum inner diameter of a mouthpiece.

The configuration of the mute 1 has been described above.

To use the mute 1 for a muting function, a user connects the head 30 to the body 20 by engaging the flanges 33 and 23 with the connecting member 40, in a state in which the sealing face 33S of the flange 33 of the head 30 faces the sealing face 23S of the flange 23 of the body 20 to join therewith. Furthermore, the user slides the rod-like member 50 so that the end 52 of the rod-like member 50 is located close to the bottom member 34, and rotates clockwise the rotation operator 37 of the stopper 36 to fix the rod-like member 50 to the head 30. In this way, the user assembles the mute 1 into the mode for use shown in FIG. 1.

Thereafter, the user inserts the mute 1 in this mode into the bell 3 of a tuba from the small diameter end 62 of the inner head 60. When the buffer material 24 of the body 20 is brought into contact with the inner circumferential face of the bell 3 so that the body 20 is fixed to the inner circumferential face of the bell 3, the bottom member 34 of the small diameter end 32 of the head 30 is located in front of the end of the bell 3. Then, the user plays a tuba with the mute 1 being attached. The sound produced in the bell 3 during playing is transmitted to the space S formed by the integration of the body 20 and the head 30. The sound transmitted to the space S is muted (muffled) in the space S. In other words, the mute 1 in the mode for use mutes the sound produced in the bell 3, as similar to conventional mutes.

Furthermore, when the mute 1 in the mode for use is attached to the bell 3, the inner head 60 is located at an appropriate position, and the outer circumferential face of the inner head 60 projects toward the inner circumferential face of the bell 3. Since the small diameter end 64 of the inner head 60 is closed, the exhaled air blown into a tuba from a mouthpiece passes through the gap formed between the outer circumferential face of the inner head 60 and the inner circumferential face of the bell 3, and is brought into the space S via the small diameter end 22 of the body 20. Since the path of the exhaled air brought into the space S is narrowed by the inner head 60, the muted sound is inhibited from going off-key from the non-muted sound. Furthermore, the exhaled air brought into the space S is discharged into the outer space of the mute 1 through the pipe 39 and the air hole 38.

Next, the case of storing the mute 1 after use will be described. FIGS. 4 to 7 show assembly diagrams of the mute 1 which explain a procedure of reassembling the mute 1 from the mode for use to the mode for storage. When the user stores the mute 1 after use, the user reassembles the mute 1 in the order of FIGS. 1, 4, 5, 6, 7, and 2.

Figure 4:
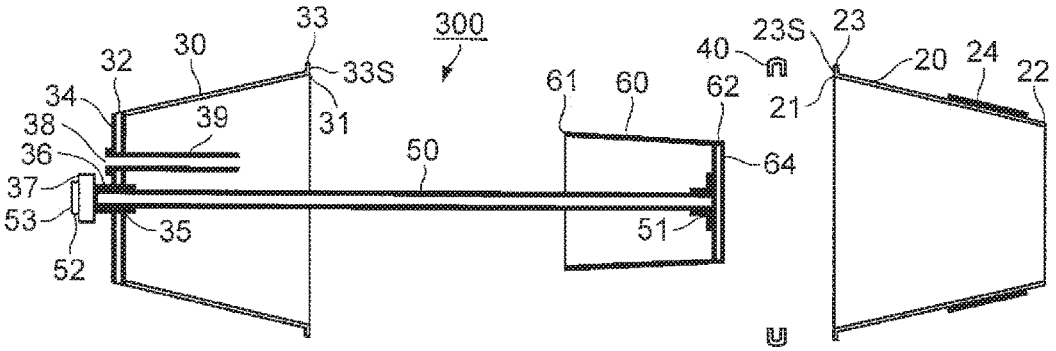
FIG. 4 is an assembly diagram of the mute 1 illustrating a procedure of reassembling from a mode for use to a mode for storage.

Firstly, the user removes the mute 1 attached to the tuba (the mute 1 of FIG. 1) out of the bell 3. As shown in FIG. 4, the user then removes the connecting member 40 from the flanges 23 and 33, whereby the body 20 and the head 30 that were connected are separated, and thus, the mute 1 is divided into: a portion in which the head 30, the rod-like member 50, and the inner head 60 are integrated (hereinafter, referred to as "head side portion 300"); the body 20; and the connecting member 40. Next, the user moves the head side portion 300 in such a manner that the head 30 moves away along the axis from the body 20 and the connecting member 40. During this movement of the head side portion 300, the inner head 60 passes in the body 20 in such a manner that the inner head 60 enters the body 20 from the small diameter end 22 of the body 20 and exits the body 20 from the large diameter end 21 of the body 20 (in other words, the inner head 60 is formed so as to be able to pass through the opening of the small diameter end 22 of the body 20). Furthermore, the connecting member 40 moves on the outer circumference of the inner head 60 in such a manner that the connecting member 40 enters the area on the outer circumference of the inner head 60 from the large diameter end 61 of the inner head 60 and exits the area on the outer circumference of the inner head 60 from the small diameter end 62 of the inner head 60. In the state shown in FIG. 4, the small diameter end 62 of the inner head 60 (i.e. the outer face of the bottom member 64) faces the large diameter end 21 of the body 20.

Figure 5:
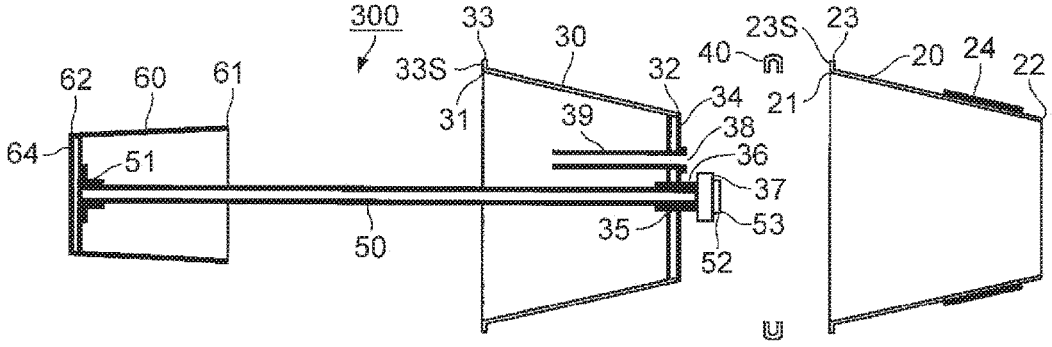
FIG. 5 is an assembly diagram of the mute 1 illustrating a procedure of reassembling from a mode for use to a mode for storage.

Next, as shown in FIG. 5, the user inverts the orientation of the head side portion 300 back to front, by replacing the position of the head 30 with the position of the inner head 60, whereby the small diameter end 32 of the head 30 (i.e. the outer face of the bottom member 34) faces the large diameter end 21 of the body 20.

Figure 6:
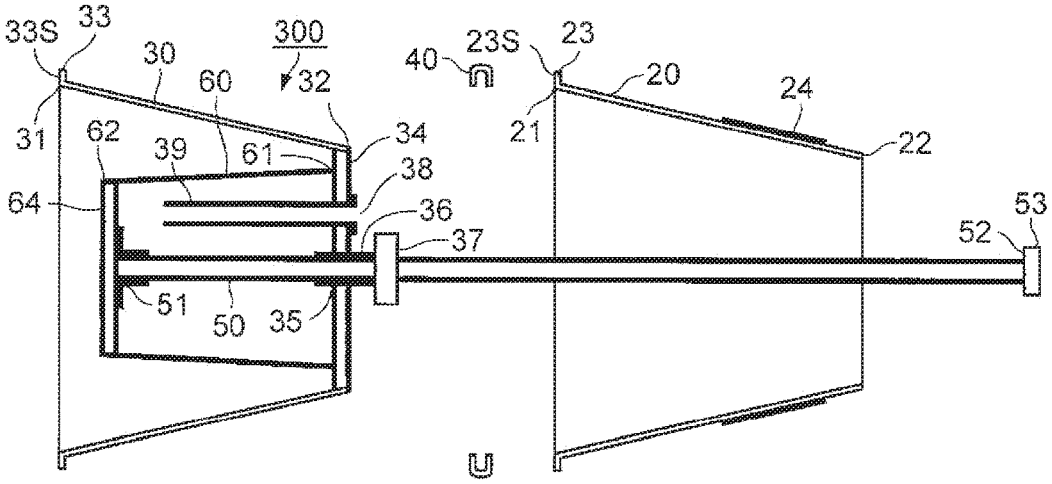
FIG. 6 is an assembly diagram of the mute 1 illustrating a procedure of reassembling from a mode for use to a mode for storage.

Next, as shown in FIG. 6, the user stores the inner head 60 in the head 30. More specifically, the user firstly rotates anticlockwise the rotation operator 37 of the stopper 36 of the head 30 to reduce the force to hold the rod-like member 50 at the head 30 and permit the rod-like member 50 to slide. Next, the user slides the rod-like member 50 in a direction from the end 51 toward the end 52 to move the inner head 60. As the rod-like member 50 is slid, the inner head 60 is inserted into the head 30 via the large diameter end 31, which is open, of the head 30 from the large diameter end 61 of the inner head 60. As a result, the entire inner head 60 is placed in the head 30. At this moment, the end 52 of the rod-like member 50 significantly protrudes toward the outer face of the bottom member 34 of the head 30, as compared to the state before placing of the inner head 60 in the head 30. The user then rotates clockwise the rotation operator 37 of the stopper 36 to increase the force to hold the rod-like member 50 of the head 30, in the state of the inner head 60 being placed in the head 30, to fix the rod-like member 50 to the head 30.

Figure 7:
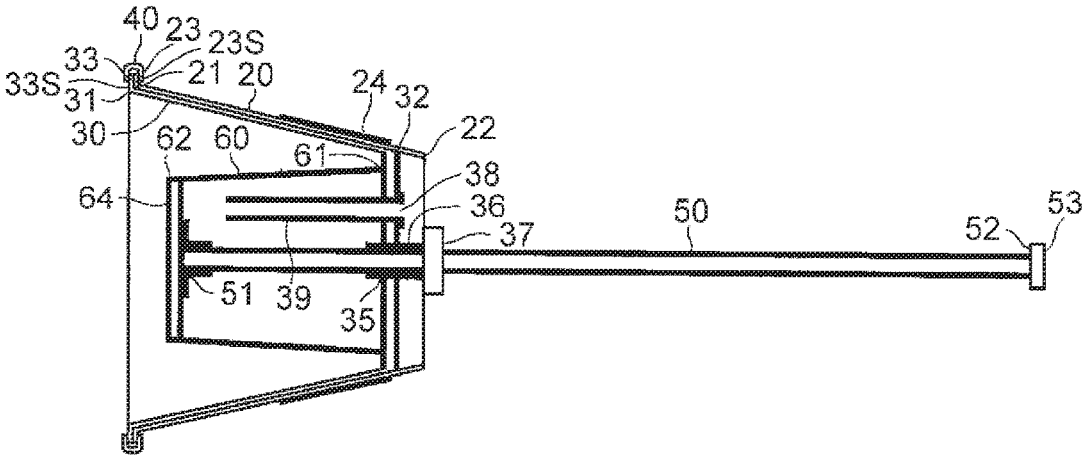
FIG. 7 is an assembly diagram of the mute 1 illustrating a procedure of reassembling from a mode for use to a mode for storage.

Next, the user inserts the head side portion 300 into the body 20 via the large diameter end 21 of the body 20, from the end 52 of the rod-like member 50 that significantly protrudes toward the outer face of the bottom member 34. At this moment, the end 52 of the rod-lie member 50 passes in the body 20 from the large diameter end 21 of the body 20, and exits the body 20 from the small diameter end 22. Meanwhile, as the head side portion 300 is inserted, the head 30 is inserted into the body 20 from the small diameter end 34. As shown in FIG. 7, the user then inserts the head side portion 300 into the body 20 until the opposite face to the sealing face 33S of the flange 33 of the head 30 is brought into contact with the sealing face 23S of the flange 23 of the body 20. Thus, the head 30 is placed in the body 20. In this state, the outer circumferential face of the head 30 is in contact with the inner circumferential face of the body 20.

Next, in the state of the flange 23 and the flange 33 being in contact with each other, the user moves the connecting member 40 in a direction away from the axis to extend the connecting member 40 and then provides the connecting member 40 around the rim portions of the flanges 23 and 33. The user then attaches the connecting member 40 to the flanges 23 and 33 in such a manner that both the flanges 23 and 33 are inserted into the recess 42 of the connecting member 40, whereby the body 20 is connected to the head 30, and the head side portion 300, the body 20, and the connecting member 40 are integrated. In this way, the mute 1 is reassembled into the mode for storage shown in FIG. 2.

Next, as shown in FIG. 2, the user inserts the mute 1, which was reassembled into the mode for storage, into the bell 3 from the small diameter end 22 of the body. As shown in FIG. 2, when the body 20 of the mute 1, which was reassembled into the mode for storage, is fixed to the inner circumferential face of the bell 3, the large diameter end 21 of the body 20 is located close to or in rear of the end of the bell 3 (in other words, the large diameter end 21 of the body 20 of the mute 1, which was reassembled into the mode for storage, is located close to or in rear of the end position of the bell 3 in the axial direction). In the example of FIG. 2, the large diameter end 21 of the body 20 is aligned with the end of the bell 3. In the mute 1 in the mode for storage, since the head 30 is placed in the body 20, and the inner head 60 is placed in the head 30 (specifically, since the head 30 is placed in a space surrounded by the inner circumferential face of the body 20, and the inner head 60 is placed in a space surrounded by the inner circumferential face of the head 30), the entire mute 1 is placed in the bell 3.

The procedure of reassembling the mute 1 from the mode for use to the mode for storage has been described above.

When reassembling the mute 1 from the mode for storage to the mode for use, the user may inversely perform the aforementioned procedure of reassembling the mute 1 from the mode for use to the mode for storage. More specifically, the user firstly takes out the mute 1 in the mode for storage from the bell 3. Next, the user removes the connecting member 40 from the body 20 and the head 30, and separates the body 20 from the head 30. Then, the user takes out the head side portion 300 from the body 20. The user then pushes out the inner head 60 from the head 30, and inverts the orientation of the head side portion 300 back to front. Subsequently, the user connects the flange 23 with the flange 33 by means of the connecting member 40 in a state in which the sealing face 23S of the flange 23 of the body 20 faces the sealing face 33S of the flange 33 of the head 30 to join therewith.

An example of the process of handling the mute 1 has been described above. It is to be noted that a detailed procedure of reassembling the mute 1 from the mode for use to the mode for storage, and vice versa, is not limited to the aforementioned procedure.

As described above, in the mute 1 which was reassembled into the mode for storage, the head 30 and the inner head 60 are placed in the body 20. Therefore, when the body 20 of the mute 1 in the mode for storage is inserted into the bell 3, the entire mute 1 is placed in the space in the bell 3. Therefore, storage of the mute 1 according to the present embodiment together with a tuba in a musical instrument storing case is enabled, by reassembling the mute 1 into the mode for storage.

Furthermore, in the mute 1 according to the present embodiment, the large diameter end 31 of the body 20 is aligned with the end of the bell 3 in the state of the body 20 being inserted into the bell 3 and fixed thereto. Therefore, the entire mute 1, which was reassembled into the mode for storage, is enabled to be reliably stored in the bell 3, and is therefore enabled to be reliably stored together with a tuba in a musical instrument storing case.

Moreover, when the mute 1 in the mode for use is inserted into the bell 3, the body 20 and the head 30 mute the sound in the bell 3, while the inner head 60 inhibits the sound from going off-key during playing.

Second Embodiment

Figure 8:
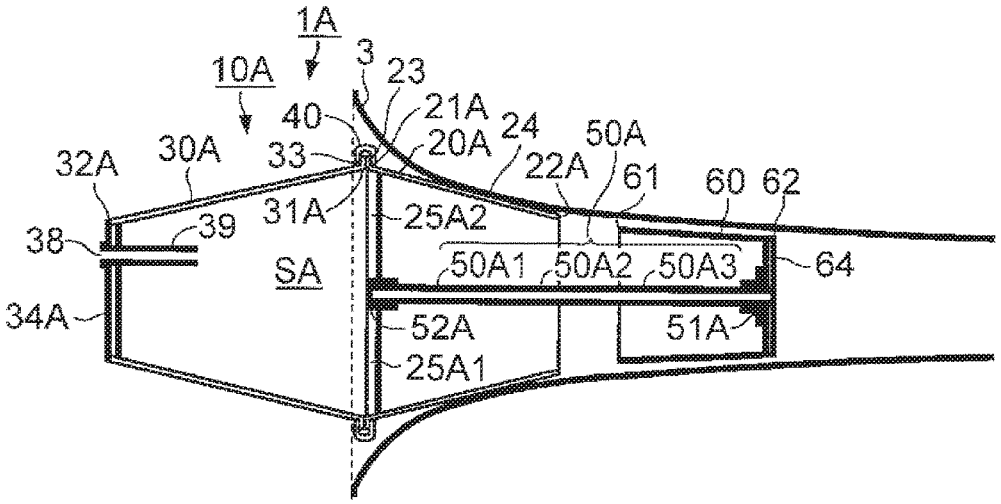
FIG. 8 is a longitudinal cross sectional view showing a configuration of a mute 1A in use according to the second embodiment of the present invention.
Figure 9:
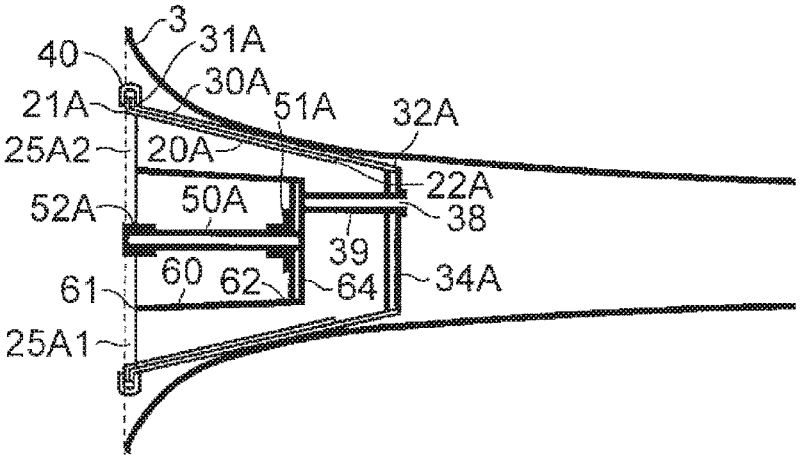
FIG. 9 is a longitudinal cross sectional view showing a configuration of the mute 1A when stored.

FIGS. 8 and 9 are longitudinal cross sectional views showing a configuration of a mute 1A according to the second embodiment of the present invention. The mute 1A of the present embodiment is used by being attached to the bell 3 of a wind instrument. The mute 1A according to the present embodiment differs from the mute 1 according to the first embodiment in that a main body portion 10A is provided in place of the main body portion 10, and that a rod-like member 50A is provided in place of the rod-like member 50. The main body portion 10A differs from the main body portion 10 according to the first embodiment in that a body 20A is provided in place of the body 20, and that a head 30A is provided in place of the head 30. Similar to the mute 1 according to the first embodiment, in the mute 1A according to the present embodiment, the head 30A and the body 20A is connectable to and separable from each other, and thus reassembling of the mute 1A from the mode for use to the mode for storage, and vice versa, is enabled. FIG. 8 shows a state in which the mute 1A in the mode for use is attached to the bell 3, and FIG. 9 shows a state in which the mute 1A in the mode for storage is placed in the bell 3. In the mute 1 according to the first embodiment, the inner head 60 is supported by the head 30 via the rod-like member 50. On the other hand, in the mute 1A according to the present embodiment, the inner head 60 is supported by the body 20A via the rod-like member 50A.

The head 30A differs from the head 30 according to the first embodiment in that a bottom member 34A is provided in place of the bottom member 34. The bottom member 34A differs from the bottom member 34 according to the first embodiment in that a portion corresponding to the through-hole 35 and a portion corresponding to the stopper 36 in the first embodiment are not provided. Furthermore, the head 30A differs from the head 30 according to the first embodiment in that the head 30A is longer than the body 20A in the axial direction. In addition, similar to the body 20A, the head 30A has a diameter which increases in such a manner that the head 30A follows the inner circumferential face of the bell 3 from a small diameter end 32A toward a large diameter end 31A.

The rod-like member 50A differs from the rod-like member 50 according to the first embodiment in that the length thereof is enabled to be adjusted in the axial direction. For example, the rod-like member 50A has a telescopic structure in which a medium diameter pipe 50A2 is inserted in a large diameter pipe 50A1 and thus connected, and a small diameter pipe 50A3 is inserted in the medium diameter pipe 50A2 and thus connected. In the case in which the length of the rod-like member 50A is minimized in the axial direction by placing the small diameter pipe 50A3 in the medium diameter pipe 50A2 and placing the medium diameter pipe 50A2 in the large diameter pipe 50A1, the rod-like member 50A is shorter than the body 20A in the axial direction. On the other hand, in the case in which the length of the rod-like member 50A is maximized in the axial direction by pulling the small diameter pipe 50A3 out of the medium diameter pipe 50A2 and pulling the medium diameter pipe 50A2 out of the large diameter pipe 50A1, the rod-like member 50A is longer than the body 20A in the axial direction.

A plurality of spokes, as support members for supporting the rod-like member 50A, are provided close to the large diameter end 21A of the body 20A in such a manner that one end of each spoke is fixed at the position of the axis of the body 20A and each spoke extends radially therefrom toward the inner circumferential face of the body 20A. In other words, the body 20A comprises support members that are fixed to the large diameter end 21A. FIG. 8 shows two spokes 25A1 and 25A2 among the radial spokes. Hereinafter, the plurality of spokes including the spokes 25A1 and 25A2 are collectively referred to as a spoke 25A. One end of the rod-like member 50A is fixed at the common fixed position of each one end of the plurality of spokes 25A. The rod-like member 50A is provided along the axis of the body 20A. Furthermore, the rod-like member 50A is provided in such a manner that the entire rod-like member 50A is placed in the body 20A in the state of being minimized in length. Since there are gaps among the plurality of spokes 25A, the large diameter end 21A of the body 20A is not closed. Furthermore, the sizes of the large diameter end 21A and the small diameter end 22A are determined so that, in the state of the body 20A being fixed to the inner circumferential face of the bell 3 via the buffer material 24, the large diameter end 21A is located slightly in rear of the end of the bell 3 (in other words, located slightly in rear of the end position of the bell 3 in the axial direction).

In the rod-like member 50A, the small diameter pipe 50A3 is capable of being pulled out of and placed in the medium diameter pipe 50A2, and the medium pipe 50A2 is capable of being pulled out of and placed in the large diameter pipe 50A1 at the end 51A of the rod-like member 50A which is close to the small diameter end 22A of the body 20A (i.e. the opposite end to the end 52A to which the spoke 25A is fixed). Therefore, the end 51A of the rod-like member 50A is placed in the body 20 via the small diameter end 22A out of the body 20A, in response to the contraction of the rod-like member 50A. On the other hand, the end 51A of the rod-like member 50A protrudes out of the body 20A via the small diameter end 22A from the body 20A, in response to the expansion of the rod-like member 50A.

The end 51A of the rod-like member 50A (more accurately, the end of the small diameter pipe 50A3) is fixed at the center portion of the inner face of the bottom member 64 of the inner head 60. The inner head 60 is supported by the body 20A via the rod-like member 50A and the plurality of spokes 25A. The inner head 60 is movable in the axial direction of the rod-like member 50A in response to the expansion and the contraction of the rod-like member 50A. In the state of the length of the rod-like member 50A being maximized, the large diameter end 61 of the inner head 60 faces the small diameter end 22A of the body 20A. The inner head 60 is formed so as to be able to pass through the opening of the small diameter end 22A of the body 20A, and the inner head 60 is placed in the body 20A in response to the contraction of the rod-like member 50A. More specifically, when the large diameter end 61 of the inner head 60 is provided close to the plurality of spokes 25A, the small diameter end 62 of the inner head 60 is provided more interiorly than the small diameter end 22A of the body 20A.

As such, in the mute 1A, the inner head 60 is enabled to be stored in the body 20A. Furthermore, in the mute 1A, the body 20A in which the inner head 60 is placed is enabled to be stored in the head 30.

To use the mute 1A for a muting function, a user connects the head 30A to the body 20A by engaging the flanges 33 and 23 with the connecting member 40, in a state in which the sealing face 33S of the flange 33 of the head 30A faces the sealing face 23S of the flange 23 of the body 20A to join therewith. Furthermore, the user pulls out the inner head 60 from the body 20A so that the small diameter end 62 of the inner head 60 is located outside the body 20A. In this way, the user assembles the mute 1A into the mode for use as shown in FIG. 8 and inserts the mute 1A into the bell 3.

Figure 10:
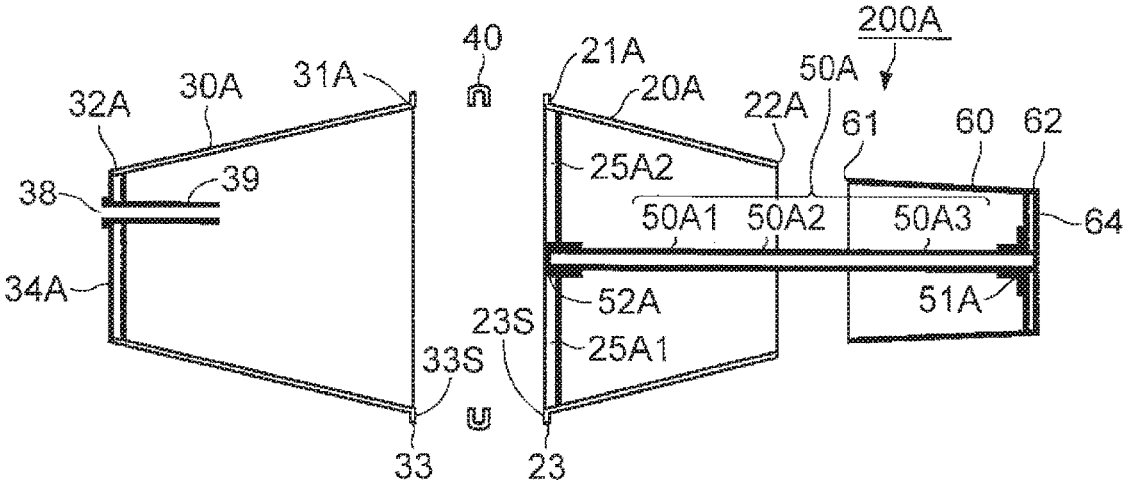
FIG. 10 is an assembly diagram of the mute 1A illustrating a procedure of reassembling from a mode for use to a mode for storage.
Figure 11:
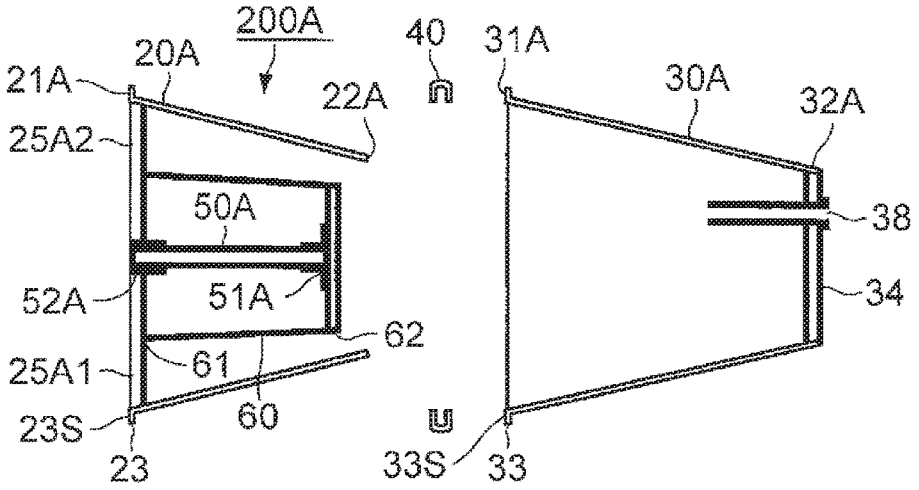
FIG. 11 is an assembly diagram of the mute 1A illustrating a procedure of reassembling from a mode for use to a mode for storage.
Figure 12:
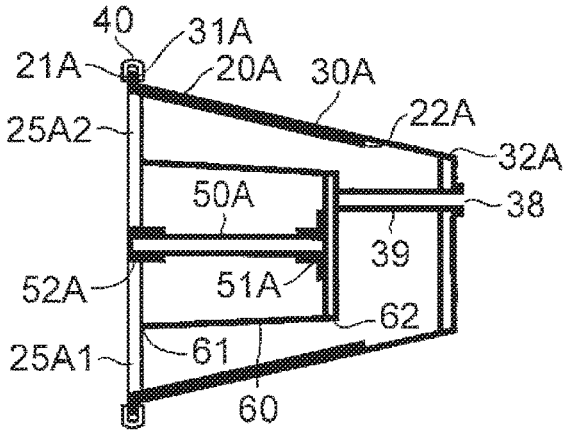
FIG. 12 is an assembly diagram of the mute 1A illustrating a procedure of reassembling from a mode for use to a mode for storage.

Next, the case of storing the mute 1A after use will be described. FIGS. 10 to 12 show assembly diagrams of the mute 1A which explain a procedure of reassembling the mute 1A from the mode for use to the mode for storage. When the user stores the mute 1A after use, the user reassembles the mute 1A in the order of FIGS. 8, 10, 11, 12, and 9.

Firstly, the user removes the mute 1A out of the bell 3. Next, the user removes the connecting member 40 from the flanges 23 and 33 to separate the body 20A and the head 30A that are connected to each other. When the body 20A is separated from the head 30A, as shown in FIG. 10, the mute 1A is divided into: a portion in which the body 20A, the rod-like member 50A, and the inner head 60 are integrated (hereinafter, referred to as "body side portion 200A"); the head 30A; and the connecting member 40.

Next, as shown in FIG. 11, the user stores the inner head 60 in the body 20A via the small diameter end 22A of the body 20A so that the small diameter end 62 of the inner head 60 is located inside the body 20A at the body side portion 200A. The user then replaces the position of the body side portion 200A with the position of the head 30A to cause the large diameter end 31A of the head 30A to face the small diameter end 22A of the body 20A.

Next, as shown in FIG. 12, the user inserts the body side portion 200A into the head 30A from the small diameter end 22A of the body 20A. At this moment, the user inserts the body side portion 200A thereinto until the opposite face to the sealing face 23S of the flange 23 of the body 20A is brought into contact with the sealing face 33S of the flange 33 of the head 30A. When the body 20A is placed in the head 30A, the buffer material 24 of the body 20A is brought into contact with the inner circumferential face of the head 30A, and the outer circumferential face of the body 20A is located close to the inner circumferential face of the head 30A. Similar to the first embodiment, the user attaches the connecting member 40 to the flanges 23 and 33 to connect the body 20A with the head 30A, whereby the body side portion 200A, the head 30A, and the connecting member 40 are integrated. The mute 1A is reassembled into the mode for storage in this way. It is to be noted that the pipe 39 of the head 30A is provided so as not to prevent the body side portion 200A from being placed in the head 30A.

Next, as shown in FIG. 9, the user inserts the mute 1A, which was reassembled into the mode for storage, into the bell 3 from the small diameter end 32A of the head 30A. The head 30A is inserted to the extent that the outer circumferential face of the head 30A is brought into contact with the inner circumferential face of the bell 3. Since, similar to the body 20A, the diameter of the head 30A increases in a manner along the inner circumferential face of the bell 3, when the mute 1A, which was reassembled into the mode for storage, is placed in the bell 3, the large diameter end 31A of the head 30A and the large diameter end 21A of the body 20A are located close to or in rear of the end of the bell 3 (in other words, the large diameter end 21A of the body 20A and the large diameter end 31A of the head 30A of the mute 1A, which was reassembled into the mode for storage, are located close to or in rear of the end position of the bell 3 in the axial direction). In the example of FIG. 9, the large diameter end 21A of the body 20A is aligned with the end of the bell 3.

When reassembling the mute 1A from the mode for storage to the mode for use, the user may inversely perform the aforementioned procedure of reassembling the mute 1A from the mode for use to the mode for storage. More specifically, the user firstly takes out the mute 1A in the mode for storage from the bell 3. The user then removes the connecting member 40 from the body 20A and the head 30A, and separates the body 20A from the head 30A. Next, the user takes out the body side portion 200A from the head 30. The user then inverts the orientation of the head 30A back to front, to replace the position of the head 30A with the position of the body side portion 200A. Subsequently, the user pulls out the inner head 60 from the body 20A. And then, the user connects the flange 23 with the flange 33 by means of the connecting member 40 in a state in which the sealing face 23S of the flange 23 of the body 20A faces the sealing face 33S of the flange 33 of the head 30A to join therewith.

An example of the process of handling the mute 1A has been described above. It is to be noted that a detailed procedure of reassembling the mute 1A from the mode for use to the mode for storage, and vice versa, is not limited to the aforementioned procedure.

As described above, in the mute 1A according to the present embodiment, in the mode for storage, the body 20A is placed in the head 30A, and the inner head 60 is placed in the body 20A (specifically, the inner head 60 is placed in a space surrounded by the inner circumferential face of the body 20A via the small diameter end 21A of the body 20A, the body 20A is separated from the head 30A, and the body 20A is placed in a space surrounded by the inner circumferential face of the head 30A). In such a mute LA, since the body 20A and the inner head 60 are placed in the head 30A having a similar shape to the body 20A, the entire mute 1A is enabled to be stored in the bell 3. Accordingly, the mute 1A achieves a similar effect to that of the first embodiment.

Third Embodiment

Figure 13:
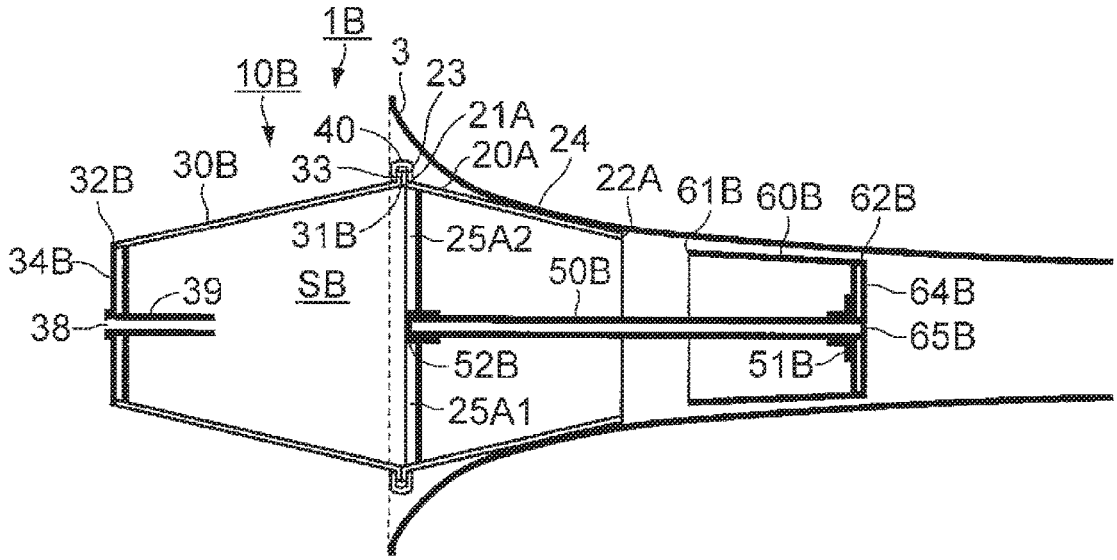
FIG. 13 is a longitudinal cross sectional view showing a configuration of a mute 1B in use according to the third embodiment of the present invention.
Figure 14:
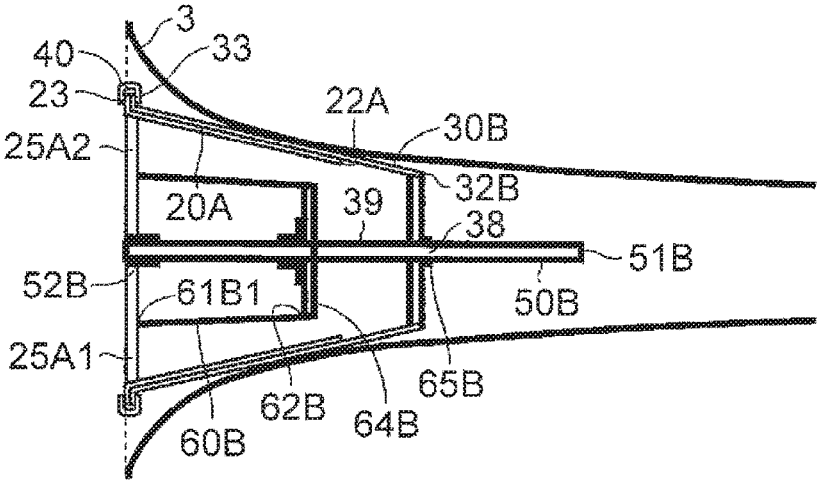
FIG. 14 is a longitudinal cross sectional view showing a configuration of the mute 1B when stored.

FIGS. 13 and 14 are longitudinal cross sectional views showing a configuration of a mute 1B according to the third embodiment of the present invention. The mute 1B of the present embodiment is used by being attached to the bell 3 of a wind instrument. The mute 1B according to the present embodiment differs from the mute 1A according to the second embodiment in that amain body portion 10B is provided in place of the main body portion 10A, a rod-like member 50B is provided in place of the rod-like member 50A, and an inner head 60B is provided in place of the inner head 60. The main body portion 10B differs from the main body portion 10A according to the second embodiment in that a head 30B is provided in place of the head 30A. FIG. 13 shows a state in which the mute 1B in the mode for use is attached to the bell 3, and FIG. 14 shows a state in which the mute 1B in the mode for storage is placed in the bell 3. Similar to the mute 1A according to the second embodiment, in the mute 1B in the mode for storage, the body 20A is placed in the head 30B, and the inner head 60B is placed in the body 20A.

The head 30B differs from the head 30A according to the second embodiment in that a bottom member 34B is provided in place of the bottom member 34A. The bottom member 34B differs from the bottom member 34A according to the second embodiment in that the air hole 38 and the pipe 39 are provided at the center of the bottom member 34B. In other words, the axes of the air hole 38 and the pipe 39 overlap with the axis of the head 30B.

The rod-like member 50B is a cylindrical rod-like member having a smaller outer diameter than the inner diameters of the air hole 38 and the pipe 39. The rod-like member 50B is longer than the body 20A in the axial direction. The rod-like member 50B is located along the axis of the body 20A. One end 52B of the rod-like member 50B is located close to the large diameter end 21A in the body 20A (close to the location of the large diameter end 21A in the axial direction of the body 20A). The rod-like member 50B extends in a direction from the vicinity of the large diameter end 21A in the body 20A toward the small diameter end 22A of the body 20A, and the other end 51B of the rod-like member 50B is located outside the body 20A. Similar to the second embodiment, the end 52B on the large diameter side of the rod-like member 50B is fixed to the body 20A via the plurality of spokes 25A.

The inner head 60B differs from the inner head 60 according to the second embodiment in that a bottom member 64B is provided in place of the bottom member 64. The bottom member 64B differs from the bottom member 64 according to the second embodiment in that a circular through-hole 65B is provided that extends through the bottom member 64B at the center of the bottom member 64B having a plate-like shape.

The rod-like member 50B is inserted into the through-hole 65B. The end 52B is located at the inner face of the bottom member 64B in the state of the rod-like member 50B being inserted into the through-hole 65B. The rod-like member 50B is in contact with the rim portion of the through-hole 65B with a frictional force to the extent that the rod-like member 50B can be slid with respect to the bottom member 64B in the axial direction. In other words, the inner head 60B is capable of being slid along the rod-like member 50B, and is supported by the body 20A via the rod-like member 50B and the plurality of spokes 25A.

As shown in FIG. 13, in the state of the end 51B of the rod-like member 50B being located close to the bottom member 64B, the large diameter end 61B of the inner head 60B faces the small diameter end 22A of the body 20A. The inner head 60B is formed so as to be able to pass through the opening of the small diameter end 22A of the body 20A, and the inner head 60B is placed in the body 20A via the small diameter end 22A of the body 20A, as the inner head 60B is slid in a direction from the end 51B toward the end 52B. In other words, the inner head 60B is placed in a space surrounded by the inner circumferential face of the body 20A via the small diameter end 22A of the body 20A. More specifically, when the large diameter end 61B of the inner head 60B is located close to the plurality of spokes 25A, the small diameter end 62B of the inner head 60B is located inside the small diameter end 22A of the body 20A.

In the mute 1B, the end 51B of the rod-like member 50B protrudes toward the outer face of the bottom member 64B by the amount of the sliding of the inner head 60B in the direction from the end 51B toward the end 52B. In the mute 1B, in the mode for storage shown in FIG. 14, the end 51B side portion of the rod-like member 50B which protrudes from the outer face of the bottom member 64B is inserted into the air hole 38 and the pipe 39.

To use the mute 1B for a muting function, a user connects the head 30B to the body 20A by engaging the flanges 33 and 23 with the connecting member 40, in a state in which the sealing face 33S of the flange 33 of the head 30B faces the sealing face 23S of the flange 23 of the body 20A to join therewith. Furthermore, the user slides the inner head 60B to pull out from the body 20A so that the small diameter end 62B of the inner head 60B is located outside the body 20A. In this way, the user assembles the mute 1B into the mode for use as shown in FIG. 13 and inserts the mute 1B into the bell 3.

Figure 15:
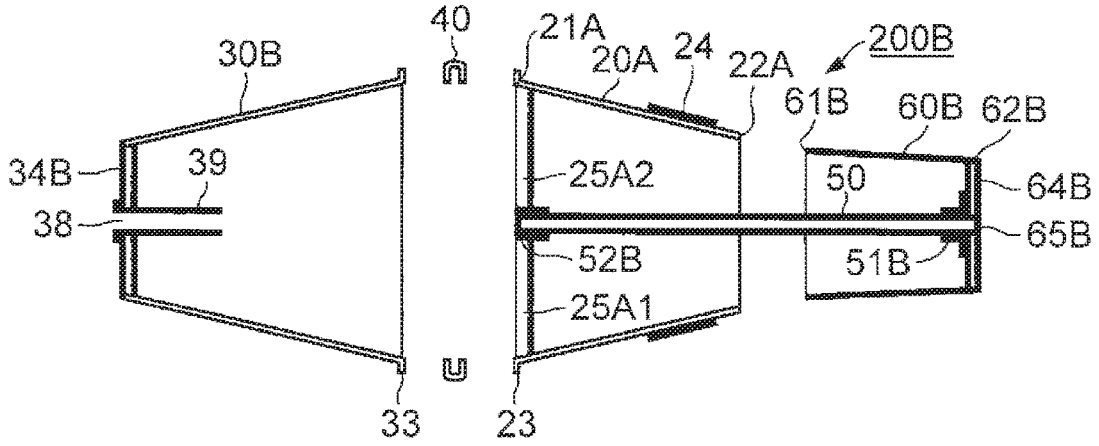
FIG. 15 is an assembly diagram of the mute 1B illustrating a procedure of reassembling from a mode for use to a mode for storage.
Figure 16:
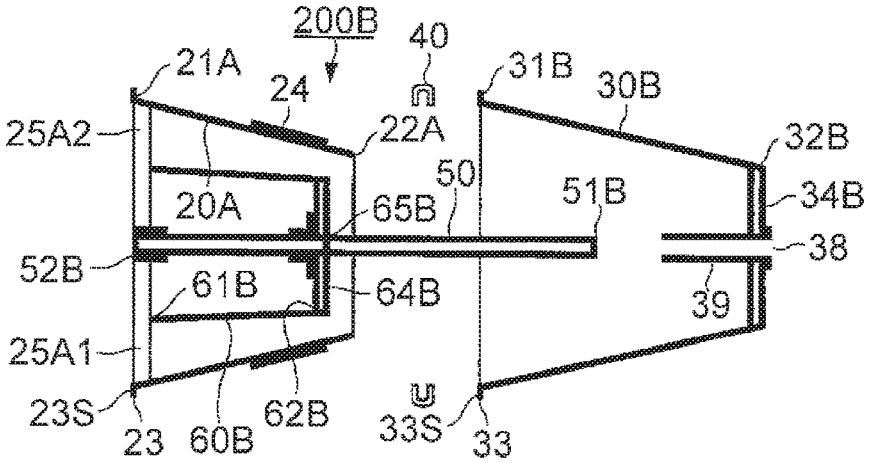
FIG. 16 is an assembly diagram of the mute 1B illustrating a procedure of reassembling from a mode for use to a mode for storage.
Figure 17:
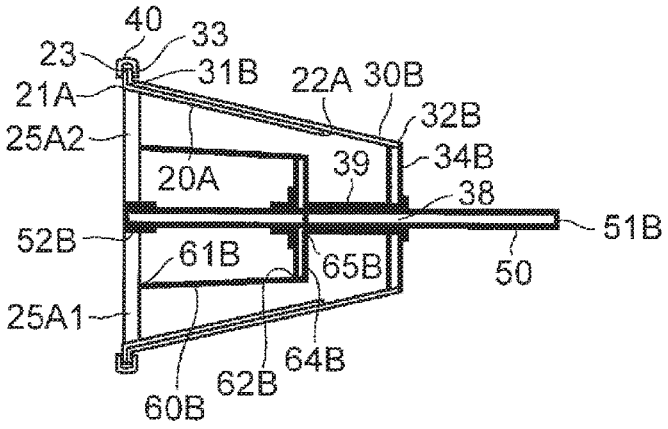
FIG. 17 is an assembly diagram of the mute 1B illustrating a procedure of reassembling from a mode for use to a mode for storage.

Next, the case of storing the mute 1B after use will be described. FIGS. 15 to 17 show assembly diagrams of the mute 1B which explain a procedure of reassembling from the mode for use to the mode for storage. When the user stores the mute 1B after use, the user reassembles the mute 1B in the order of FIGS. 13, 15, 16, 17, and 14.

Firstly, the user removes the mute 1B out of the bell 3. Similar to the second embodiment, the body 20A and the head 30B are separated from each other. When the body 20A is separated from the head 30B, as shown in FIG. 15, the mute 1B is divided into: a portion in which the body 20A, the rod-like member 50B, and the inner head 60B are integrated (hereinafter, referred to as "body side portion 200B"); the head 30B; and the connecting member 40.

Next, as shown in FIG. 16, the user slides the inner head 60B in a direction from the end 51B toward the end 52B at the body side portion 200B, and stores the inner head 60B in the body 20A so that the small diameter end 62B of the inner head 60B is located inside the body 20A. The user then replaces the position of the body side portion 200B with the position of the head 30B to cause the large diameter end 31B of the head 30B to face the small diameter end 22A of the body 20A.

Next, as shown in FIG. 16, the user inserts the rod-like member 50B from the end 51B into the pipe 39 of the head 30B in a state in which the axis of the body side portion 200B is aligned with the axis of the head 30B. With the rod-like member 50B being inserted into the pipe 39, the body 20A is inserted into the head 30B from the small diameter end 22A. In this way, the user inserts the body 20A into the head 30B until the opposite face to the sealing face 23S of the flange 23 of the body 20A is brought into contact with the sealing face 33S of the flange 33 of the head 30B. When the body 20A is placed in the head 30B, the buffer material 24 of the body 20A is brought into contact with the inner circumferential face of the head 30B, and the outer circumferential face of the body 20A is located close to the inner circumferential face of the head 30B. Similar to the second embodiment, the user engages the connecting member 40 with the flanges 23 and 33 to connect the body 20A to the head 30B. As a result, as shown in FIG. 17, the body side portion 200B, the head 30B, and the connecting member 40 are integrated. In this way, the mute 1B is reassembled into the mode for storage.

Next, as shown in FIG. 14, similar to the mute 1A according to the second embodiment, the user inserts the mute 1B, which was reassembled into the mode for storage, into the bell 3. When the mute 1B, which was reassembled into the mode for storage, is placed in the bell 3, the large diameter end 31B of the head 30B and the large diameter end 21A of the body 20A are located close to or in rear of the end of the bell 3 (in other words, the large diameter end 21A of the body 20A and the large diameter end 31B of the head 30B of the mute 1B, which was reassembled into the mode for storage, are located close to or in rear of the end position of the bell 3 in the axial direction).

When reassembling the mute 1B from the mode for storage to the mode for use, the user may inversely perform the aforementioned procedure of reassembling the mute 1B from the mode for use to the mode for storage. Since the procedure is similar to the procedure for the mute 1A of the second embodiment, the descriptions therefor will be omitted.

An example of the process of handling the mute 1B has been described above. It is to be noted that a detailed procedure of reassembling the mute 1B from the mode for use to the mode for storage, and vice versa, is not limited to the aforementioned procedure.

As described above, in the mute 1B according to the present embodiment, similar to the second embodiment, in the mode for storage, the body 20A is placed in the head 30B, and the inner head 60B is placed in the body 20A (specifically, the body 20A is separated from the head 30B, the other end (the end 51B) of the rod-like member 50B which extends through the inner head 60B is inserted into the air hole 38 of the head 30B, and the body 20A is placed in a space surrounded by the inner circumferential face of the head 30B). Accordingly, the mute 1B achieves a similar effect to that of the second embodiment.

Fourth Embodiment

Figure 18:
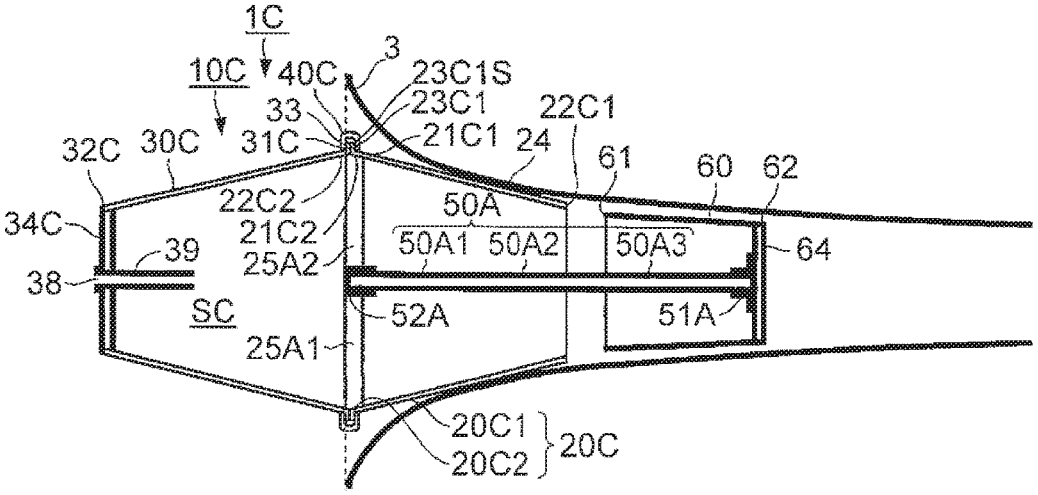
FIG. 18 is a longitudinal cross sectional view showing a configuration of a mute 1C in use according to the fourth embodiment of the present invention.
Figure 19:
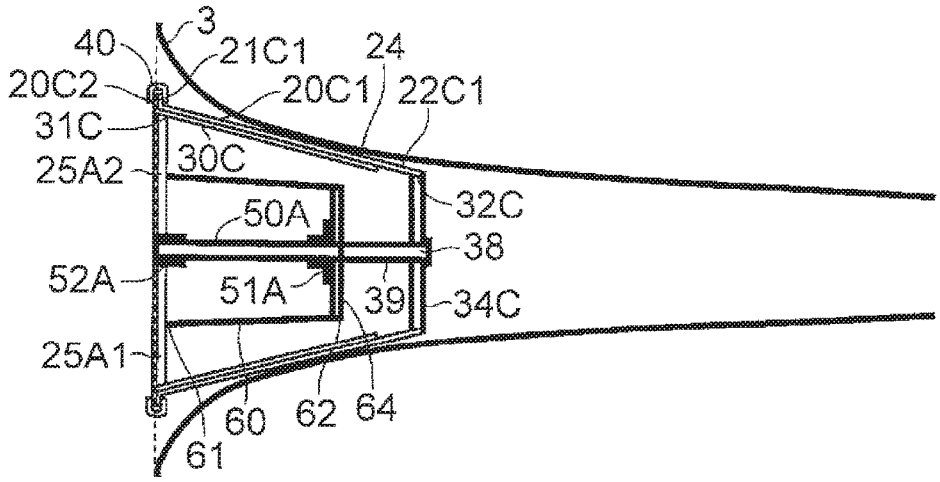
FIG. 19 is a longitudinal cross sectional view showing a configuration of the mute 1C when stored.

FIGS. 18 and 19 are longitudinal cross sectional views showing a configuration of a mute 1C according to the fourth embodiment of the present invention. FIG. 18 shows a state in which the mute 1C in the mode for use is attached to the bell 3, and FIG. 19 shows a state in which the mute 1C in the mode for storage is placed in the bell 3. The mute 1C according to the present embodiment is used by being attached to the bell 3 of a wind instrument. The mute 1C according to the present embodiment differs from the mute 1A according to the second embodiment in that a main body portion 10C is provided in place of the main body portion 10. The main body portion 10C differs from the main body portion 10 according to the second embodiment in that a head 30C is provided in place of the head 30A, a body 20C is provided in place of the body 20A, and a connecting member 40C is provided in place of the connecting member 40.

The head 30C differs from the head 30A according to the second embodiment in that a bottom member 34C is provided in place of the bottom member 34A. Similar to the bottom member 34B according to the third embodiment, the bottom member 34C differs from the bottom member 34A according to the second embodiment in that the air hole 38 and the pipe 39 are provided at the center of the bottom member 34C.

The body 20C differs from the body 20A according to the second embodiment in being constituted from a first body 20C1 and a second body 20C2. The first body 20C1 and the second body 20C2 are separable from each other.

The first body 20C1 is a hollow member having a substantially conical pipe-like shape. The first body 20C1 has a diameter which increases in such a manner that the first body 20C1 follows the inner circumferential face of the bell 3 from the small diameter end 22C1 toward the large diameter end 21C1. The large diameter end 21C1 and the small diameter end 22C1 of the first body 20C1 are both open. The buffer material 24 is provided at the outer circumferential face of the first body 20C1. The first body 20C1 is inserted into the bell 3 from the small diameter end 22C1. A plate-like flange 23C1 that protrudes from the large diameter end 21C1 in a direction away from the axis of the first body 20C1 is provided at the large diameter end 21C1 of the first body 20C1.

The second body 20C2 is an annular member. The inner diameter of the second body 20C2 is the same as the inner diameter of the large diameter end 21C1 of the first body 20C1 and the inner diameter of the large diameter end 31C of the head 30C. The outer diameter of the second body 20C2 is the same as the outer diameter of the flange 23C1 of the first body 20C1 and the outer diameter of the flange 33 of the head 30C. In other words, the second body 20C2 has an annular shape having the same diameter as that of the large diameter end 21C1 of the first body 20C1. The second body 20C2 is considerably shorter than the first body 20C1 in the axial direction. For example, the length of the second body 20C2 in the axial direction is substantially equivalent to the thickness of the flange 23C1 of the first body 20C1.

The second body 20C2 is located on the large diameter end 21C1 side of the first body 20C1, with the axis of the second body 20C2 and the axis of the first body 20C1 being aligned. The rod-like member 50A that is adjustable in length, as similar to the second embodiment, is provided on the axes of the first body 20C1 and the second body 20C2. The end 52A of the rod-like member 50A is located close to the end of the second body 20C2 on the first body 20C1 side (close to the end position of the second body 20C2 on the first body 20C1 side in the axial direction). One ends of the plurality of spokes 25A, which are similar support members to those of the second embodiment, are each fixed to the end 52A of the rod-like member 50A. The other ends of the plurality of spokes 25A are each fixed to the inner circumferential face of the second body 20C2. As a result, the end 52A of the rod-like member 50A is fixed to the support members, and the rod-like member 50A is adjustable in length in the axial direction of the second body 20C2.

The connecting member 40C connects the flange 23C1 of the first body 20C1 at the large diameter end 21C1, the second body 20C2, and the flange 33 of the head 30C at the large diameter end 31C. The specific configuration of the connecting member 40C is similar to that of the connecting member 40 of the first embodiment. In the connecting member 40C, an inner width 42W of the recess 42 is slightly smaller than the total of: the thickness of the flange 23C1; the thickness of the flange 33; and the length of the second body 20C2 in the axial direction. Furthermore, the inner diameter of the connecting member 40C is smaller than the outer diameter of the second body 20C2, and the outer diameter of the flanges 23C1 and 33.

In the mute 1C in the mode for use shown in FIG. 18, the first body 20C1 and the head 30C are located in such a manner that the large diameter end 21C1 of the first body 20C1 and the large diameter end 31C of the head 30C face each other, and the second body 20C2 is located between the large diameter end 21C1 of the first body 20C1 and the large diameter end 31C of the head 30C. The end 21C2 of the second body 20C2 located at the first body 20C1 faces a sealing face 23C1S of the flange 23C1 which is the large diameter end 21C1 of the first body 20C1 to join therewith. An end 22C2 opposite to the end 21C2 of the second body 20C2 faces the sealing face 33S of the flange 33 which is the large diameter end 31C of the head 30C to join therewith. The connecting member 40C is attached to the second body 20C2 and the flanges 23C1 and 33 so that the flange 23C1 of the first body 20C1, the second body 20C2, and the flange 33 of the head 30C are inserted into the recess 42. When the connecting member 40 is attached thereto, the second body 20C2 and the flanges 23C1 and 33 are pressed against each other, whereby the first body 20C1, the second body 20C2, and the head 30C are connected and fixed with one another. When the first body 20C1, the second body 20C2, and the head 30C are connected to one another in this way, the first body 20C1 and the second body 20C2 are hermetically joined together, and the second body 20C2 and the head 30C are hermetically joined together. Also, in such a state, a space SC is formed in such a manner that a space surrounded by the inner circumferential face of the first body 20C1 (a space in the first body 20C1), a space surrounded by the inner circumferential face of the second body 20C2 (a space in the second body 20C2), and a space surrounded by the inner circumferential face of the head 30C (a space in the head 30C) are integrated.

Next, the handling of the mute 1C will be described. Firstly, the case of using the mute 1C will be described. A user causes the end 21C2 of the second body 20C2 to face the sealing face 23C1S of the flange 23C1 of the first body 20C1 to join therewith, and also causes the sealing face 33S of the flange 33 of the head 30C to face the end 22C2 of the second body 20C2 to join therewith. The user then engages the flange 23C1, the second body 20C2, and the flange 33 with the connecting member 40C to connect the first body 20C1, the second body 20C2, and the head 30C with one another. Furthermore, the inner head 60 is formed so as to be able to pass through the opening of the small diameter end 22C1 of the first body 20C, and the user moves the inner head 60 so that the small diameter end 62 of the inner head 60 is located outside the first body 20C1. In this way, the user assembles the mute 1C into the mode for use and inserts the mute 1C into the bell 3. When the first body 20C1 of the mute 1C in the mode for use is fixed to the inner circumferential face of the bell 3, the large diameter end (i.e. the end 22C2 of the second body 20C2) of the body 20C, which is constituted from the first body 20C1 and the second body 20C2, is located close to or in rear of the end of the bell 3 (in other words, the large diameter end of the body 20C (the end 22C2 of the second body 20C2) is located close to or in rear of the end position of the bell 3 in the axial direction).

Figure 20:
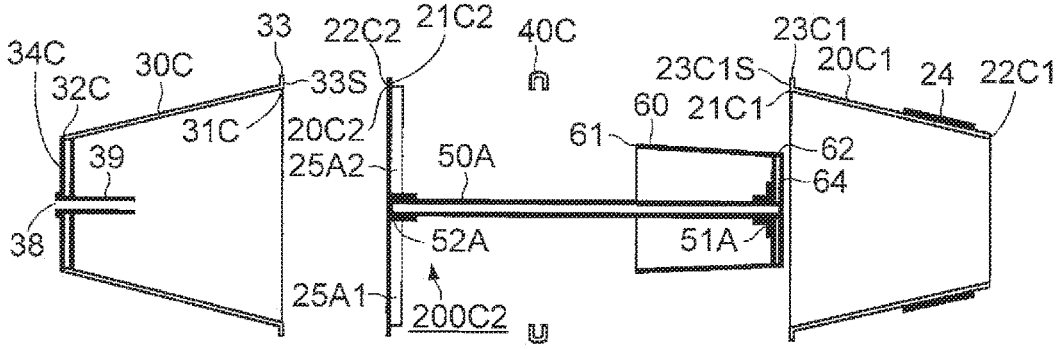
FIG. 20 is an assembly diagram of the mute 1C illustrating a procedure of reassembling from a mode for use to a mode for storage.
Figure 21:
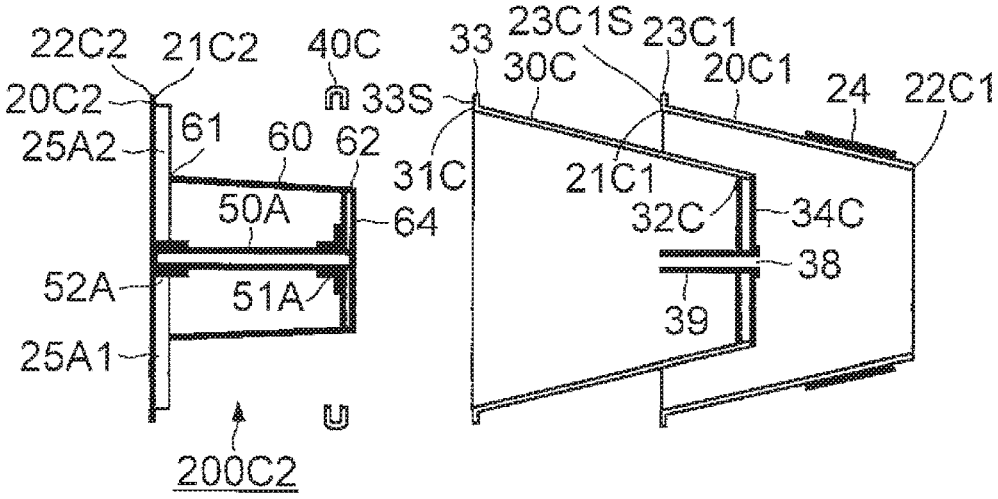
FIG. 21 is an assembly diagram of the mute 1C illustrating a procedure of reassembling from a mode for use to a mode for storage.
Figure 22:
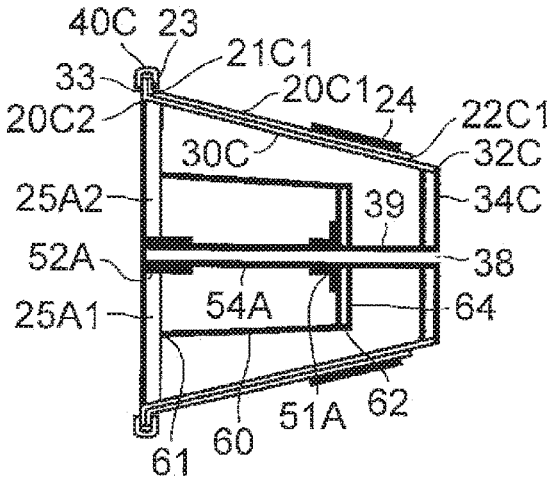
FIG. 22 is an assembly diagram of the mute 1C illustrating a procedure of reassembling from a mode for use to a mode for storage.

Next, the case of storing the mute after use will be described. FIGS. 20 to 22 show assembly diagrams of the mute 1C which explain a procedure of reassembling from the mode for use to the mode for storage. When the user reassembles the mute 1C from the mode for use to the mode for storage, the user reassembles the mute 1C in the order of FIGS. 18, 20, 21, 22, and 19.

Firstly, the user removes the mute 1C out of the bell 3. Similar to the second embodiment, the user then removes the connecting member 40C attached to the flange 23C1 of the first body 20C1, the second body 20C2, and the flange 33 of the head 30C to separate the first body 20C1, the second body 20C2, and the head 30C from one another. When they are separated from one another, as shown in FIG. 20, the mute 1C is divided into: a portion in which the second body 20C2, the rod-like member 50A, and the inner head 60 are integrated (hereinafter, referred to as "second body side portion 200C2"); the first body 20C1; the head 30C; and the connecting member 40C.

Next, as shown in FIG. 21, the user contracts the rod-like member 50A at the second body side portion 200C2, and moves the inner head 60 so that the large diameter end 61 of the inner head 60 is located close to the plurality of spokes 25A. The user then replaces the position of the second body side portion 200C2 with the position of the head 30C to provide the head 30C between the second body side portion 200C2 and the first body 20C1. The user then inverts the orientation of the head 30C back to front, so that the small diameter end 32C of the head 30C is located at the first body 20C1 and the large diameter end 31C of the head 30C is located at the second body 20C2.

The user then inserts the head 30C into the first body 20C1 from the small diameter end 32C until the opposite face to the sealing face 33S of the flange 33 of the head 30C is brought into contact with the sealing face 23C1S of the flange 23C1 of the first body 20C1. When the head 30C is placed in the first body 20C1, the outer circumferential face of the head 30C is brought into contact with the inner circumferential face of the first body 20C1. Next, the user inserts the inner head 60 into the head 30C from the small diameter end 62 until the end 21C2 of the second body 20C2 is brought into contact with the sealing face 33S of the flange 33 of the head 30C. The user then engages the connecting member 40C with the flange 23C1, the second body 20C2, and the flange 33 to connect the first body 20C1, the second body 20C2, and the head 30C with one another. As a result, the second body side portion 200C2, the head 30C, the first body 20C1, and the connecting member are integrated. In this way, the mute 1C is reassembled into the mode for storage.

Next, as shown in FIG. 19, the user inserts the mute 1C, which was reassembled into the mode for storage, into the bell 3, as similar to the mute 1 of the first embodiment. When the mute 1C, which was reassembled into the mode for storage, is placed in the bell 3, the end 22C2 of the second body 20C2 is located close to or in rear of the end of the bell 3 (in other words, the end 22C2 of the second body 20C2 of the mute 1C, which was reassembled into the mode for storage, is located close to or in rear of the end position of the bell 3 in the axial direction).

When reassembling the mute 1C from the mode for storage to the mode for use, the user may inversely perform the aforementioned procedure of reassembling the mute 1C from the mode for use to the mode for storage. Specifically, the user firstly takes out the mute 1C in the mode for storage from the bell 3. Next, the user removes the connecting member 40 from the first body 20C1, the second body 20C2, and the head 30C to separate the first body 20C1, the second body 20C2, and the head 30C from one another. Next, the user removes the head 30C from the first body 20C1, and takes out the second body side portion 200C2 from the head 30C. The user then inverts the orientation of the head 30C back to front, to replace the position of the head 30C with the position of the second body side portion 200C2. Next, the user extends the rod-like member 50A at the second body side portion 200C2. The user then causes the sealing face 23C1S of the flange 23C1 of the first body 20C1 to face the end 21C2 of the second body 20C2 to join therewith, and connects the second body 20C2 with the flanges 23C1 and 33 by means of the connecting member 40C in a state in which the end 22C2 of the second body 20C2 faces the sealing face 33S of the flange 33 of the head 30C to join therewith.

An example of the process of handling the mute 1C has been described above. It is to be noted that a detailed procedure of reassembling the mute 1C from the mode for use to the mode for storage, and vice versa, is not limited to the aforementioned procedure.

As described above, in the mute 1C according to the present embodiment, in the mode for storage, the head 30C is placed in the first body 20C1, and the inner head 60 is placed in the head 30C (specifically, the first body 20C1, the head 30C, and the second body 20C2 are separated from one another, the head 30C is placed in a space surrounded by the inner circumferential face of the first body 20C1, and the inner head 60 is placed in a space surrounded by the inner circumferential face of the head 30C). The entire mute 1C in the mode for storage is enabled to be stored in the bell 3. Accordingly, the mute 1C achieves a similar effect to that of the first embodiment.

OTHER EMBODIMENTS

Although embodiments of the present invention have been described above, other embodiments of the present invention still can be contemplated. Examples of such other embodiments are as follows.

(1) The mutes 1 to 1C according to the aforementioned embodiments are for use in a tuba. The bell of a tuba differs in size, depending on the tonal range and the purpose. The mutes 1 to 1C are each optimally designed for a tuba having such a size that is expected to be used. However, the user may use the mutes 1 to 1C by attaching to a tuba having a size different from the expected size. Furthermore, the user may attach the mutes 1 to 1C to a wind instrument other than a tuba, such as a euphonium.

Figure 23:
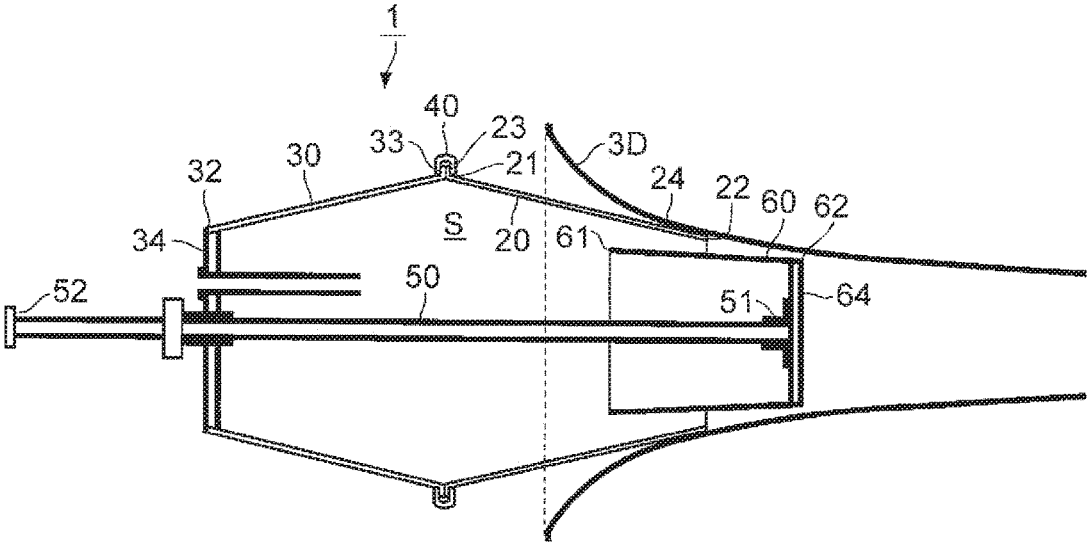
FIG. 23 is a longitudinal cross sectional view of the mute 1 reassembled into the mode for use being attached to a tuba having a bell 3D which is smaller than an expected bell.

FIG. 23 is a longitudinal cross sectional view of the mute 1, which was reassembled into the mode for use, being attached to a tuba having a bell 3D which is smaller than the expected bell. As shown in FIG. 23, when attaching the mute 1 in the mode for use, the user adjusts the position of the inner head 60 according to the size of the bell 3D. Specifically, the user slides the rod-like member 50 for fixation so that the small diameter end 62 of the inner head 60 is located close to the small diameter end 22 of the body 20. By displacing the inner head 60 in this way, prevention of blockage of the space inside the bell 3D by the inner head 60 is enabled, and prevention of deterioration of the effect of inhibiting the muted sound from going off-key is also enabled.

(2) The technical idea of each embodiment may be applied to a mute for use in other wind instruments such as a trumpet and a trombone.

(3) A microphone, a jack plug, an electronic component, etc. may be mounted to the mutes 1 to 1C of the aforementioned embodiments. For example, in the mute 1 of the first embodiment, a microphone may be provided to the end 51 of the rod-like member 50 at the inner head 60, a jack plug may be provided to the end 52 of the rod-like member 50 at the head 30, and a signal wire connecting the microphone with the jack plug may be provided in the rod-like member 50. According to this arrangement, signals representing a sound produced in the bell 3 can be extracted via a cable connected to the jack plug.

(4) In the mute 1 according to the first embodiment, the inner head 60 is fixed to the head 30 via the cylindrical rod-like member 50. This rod-like member 50 may be configured to be contractable and expandable, as similar to the rod-like member 50A of the second embodiment. When the rod-like member is contractable and expandable, the rod-like member is enabled to be stored in the head, and consequently, downsizing of the reassembled mute in the mode for storage is enabled, as compared to the mute 1 of the second embodiment.

(5) In the mute 1 of the first embodiment, the body 20 is connected to the head 30 by means of the annular connecting member 40 formed from rubber, etc. However, a connecting means is not limited to the connecting member 40 in this mode as long as the head 30 and the body 20 are connectable and separable. For example, the connecting means may be configured with a bolt that extends through the flanges 23 and 33 and a nut attached to the both ends of the bolt. Furthermore, as another example, the connecting means may also be configured by providing a protrusion to the sealing face 33S of the flange 33 of the head 30 and a recess corresponding to this protrusion to the sealing face 23S of the flange 23 of the body 20, so that insertion and removal of the protrusion of the head 30 into and from the recess of the body 20 with a predetermined frictional force are enabled. The same may also apply to the other embodiments.

(6) In the mute 1 of the first embodiment, the large diameter end 21 of the body 20 is connected to the large diameter end 31 of the head 30 by means of the connecting member 40. However, the location where a means of connecting the body with the head is provided is not limited to the location where the body 20 is brought into contact with the head 30. For example, the connecting means may be provided to extend from the large diameter end 31 of the head 30 to the outer circumferential face of the body 20, or from the outer circumferential face of the head 30 to the outer circumferential face of the body 20.

(7) In the mute 1 of the first embodiment, the main body portion 10 which exerts a muting function is divided into the body 20 and the head 30, while in the mute 1C of the fourth embodiment, the main body portion 10C is divided into the first body 20C1, the second body 20C2, and the head 30C. However, such a main body portion may be divided into more than three pieces. For example, the head may be further divided into two pieces, and the body may be divided into three pieces.

(8) The connecting member 40 of the mute 1 of the first embodiment connects the body 20 with the head 30 in both the mode for use and the mode for storage. However, the connecting member 40 is only required to connect the body 20 with the head 30 at least in the mode for use, and may not connect the body 20 with the head 30 in the mode for storage. That is, the mode for storage only requires that the head 30 is placed in the body 20. The same may also apply to the other embodiments.

(9) The mutes 1 to 1C of the aforementioned embodiments are for the purpose of muffling a sound mainly during practice of a wind instrument. However, the technical features of the mutes 1 to 1C may also be applied to mutes of which main purpose is to alter the tone by reducing the volume, such as a straight mute.

(10) As described in the aforementioned embodiments, it is preferred that, in the state of the bodies 20 to 20C being inserted into the bell 3 from the small diameter ends 22 to 22C1 and fixed to the inner circumferential face of the bell 3, the large diameter ends 21 to 22C2 are located close to or in rear of the end of the bell 3. However, the large diameter ends of the bodies 20 to 20C may also be located in front of the end of the bell 3.

EXPLANATION OF THE REFERENCE SYMBOLS

1,1A, 1B, 1C Mute
3,3D Bell
10, 10A, 10B, 10C Main body portion
20, 20A, 20C Body
20C1 First body
20C2 Second body
21, 21A, 21C1, 31, 31A, 31B, 31C, 61, 61B Large diameter end
22, 22A, 22C1, 32, 32A, 32B, 32C, 62, 62B Small diameter end
23, 23C1, 33 Flange
23S, 23C1S, 33S Sealing face
24 Buffer material
25A, 25A1, 25A2 Spoke
30, 30A, 30B, 30C Head
34, 34A, 34B, 34C, 64, 64B Bottom member
35 Through-hole
36 Stopper
37 Rotation operator
38 Air hole
39 Pipe
40, 40C Connecting member
42 Recess
42W Inner width
50, 50A, 50B Rod-like member
50A1 Large diameter pipe
50A2 Medium diameter pipe
50A3 Small diameter pipe
51, 51A, 51B, 52, 52A, 52B End
53 Collar
60, 60B Inner head
200 Bell side portion
200A, 200B Body side portion
200C2 Second body side portion
300 Head side portion
S, SA, SB, SC Space

The invention claimed is:

1. A mute for use in a wind instrument by being attached to a bell of the wind instrument, the mute comprising:

a pipe-like hollow body comprising a small diameter end and a large diameter end, with both ends being open;

a pipe-like hollow head comprising a small diameter end which is closed by a bottom member and has a through-hole at the bottom member, and a large diameter end which is open and has a same diameter as that of the large diameter end of the body, wherein the head is connectable to the body such that the large diameter end of the body faces the large diameter end of the head to join therewith;

a rod-like member that is inserted into the through-hole and is slidable in an axial direction; and an inner head that is fixed to one end of the rod-like member to be supported by the head, wherein in storing, the body and the head are separated from each other, and the head is placed in a space surrounded by an inner circumferential face of the body, and the inner head is placed in a space surrounded by an inner circumferential face of the head.

2. The mute according to claim 1, wherein, in a state of the body being inserted into the bell from the small diameter end of the body and fixed to an inner face of the bell, the large diameter end of the body is located close to or in rear of an end of the bell.

3. A mute for use in a wind instrument by being attached to a bell of the wind instrument, the mute comprising:

a pipe-like hollow body comprising a small diameter end and a large diameter end, with both ends being open, and a support member fixed to the large diameter end;

a pipe-like hollow head comprising a small diameter end which is closed by a bottom member and a large diameter end which is open and has a same diameter as that of the large diameter end of the body, wherein the head is connectable to the body such that the large diameter end of the body faces the large diameter end of the head to join therewith;

a rod-like member that has one end fixed to the support member and is adjustable in length in an axial direction of the body; and an inner head that is fixed to another end of the rod-like member;

wherein in storing, the inner head is placed in a space surrounded by an inner circumferential face of the body via the small diameter end of the body, the body and the head are separated from each other, and the body is placed in a space surrounded by an inner circumferential face of the head.

4. A mute for use in a wind instrument by being attached to a bell of the wind instrument, the mute comprising:

a pipe-like hollow body comprising a small diameter end and a large diameter end, with both ends being open, and a support member fixed to the large diameter end;

a pipe-like hollow head comprising a small diameter end which is closed by a bottom member and has an air hole at the bottom member, and a large diameter end which is open and has a same diameter as that of the large diameter end of the body, wherein the head is connectable to the body such that the large diameter end of the body faces the large diameter end of the head to join therewith;

a rod-like member that has one end fixed to the support member; and an inner head into which another end of the rod-like member is inserted and that is slidable along the rod-like member, wherein in storing, the inner head is placed in a space surrounded by an inner circumferential face of the body via a small diameter end of the body, and the body and the head are separated from each other, the another end of the rod-like member that extends through the inner head is inserted into the air hole of the head, and the body is placed in a space surrounded by an inner circumferential face of the head.

5. The mute according to claim 1, wherein the inner head has a shape capable of passing through an opening of the small diameter end of the body or the first body.

6. The mute according to claim 3, wherein the inner head has a shape capable of passing through an opening of the small diameter end of the body or the first body.

7. The mute according to claim 4, wherein the inner head has a shape capable of passing through an opening of the small diameter end of the body or the first body.

* * * * *